US010521999B1

(12) United States Patent
Itkis et al.

(10) Patent No.: US 10,521,999 B1
(45) Date of Patent: Dec. 31, 2019

(54) GAMING MACHINE HAVING FOLDABLE UTILITY SHELF

(71) Applicant: Fortunet, Inc., Las Vegas, NV (US)

(72) Inventors: Yuri Itkis, Las Vegas, NV (US); Horia Mihai Preda, Las Vegas, NV (US); Ioan Marius Puscas, Las Vegas, NV (US)

( * ) Notice: Subject to any disclaimer, the term of this patent is extended or adjusted under 35 U.S.C. 154(b) by 0 days.

(21) Appl. No.: 16/108,005

(22) Filed: Aug. 21, 2018

(51) Int. Cl.

| | |
|---|---|
| ***G07F 17/32*** | (2006.01) |
| ***A47B 5/04*** | (2006.01) |
| ***G07F 17/34*** | (2006.01) |
| ***A63F 3/06*** | (2006.01) |

(52) U.S. Cl.
CPC ..... *G07F 17/3216* (2013.01); *A47B 5/04* (2013.01); *A63F 3/062* (2013.01); *G07F 17/34* (2013.01)

(58) Field of Classification Search
CPC ..... G07F 17/3216; G07F 17/34; A47B 5/04; A63F 3/062
See application file for complete search history.

(56) References Cited

U.S. PATENT DOCUMENTS

2005/0052850 A1* 3/2005 Dickey ..... G06F 1/181 361/724
2006/0199647 A1* 9/2006 Anderson ..... A63F 13/08 463/46
2006/0238087 A1* 10/2006 Holt ..... A47B 21/00 312/321.5
2007/0054742 A1* 3/2007 McComb ..... G07F 17/32 463/46
2018/0085667 A1* 3/2018 Tsutsui ..... A63F 13/25

OTHER PUBLICATIONS

Vewlix L, Taito, Aug. 10, 2014, downloaded on Feb. 26, 2019, available at <<https://wiki.arcadeotaku.com/w/File:Taito_Vewlix_L_Manual_Part_1.pdf>>. (Year: 2014).*

* cited by examiner

*Primary Examiner* — Werner G Garner
(74) *Attorney, Agent, or Firm* — FisherBroyles, LLP; Rob L. Phillips

(57) ABSTRACT

A gaming machine having a utility shelf movably attached thereto wherein the utility shelf is adapted to move between a stowed position and a play position where the stowed position is substantially non-horizontal and the play position is substantially horizontal. In this manner, gaming machine players may play bingo (or other live, card-based games) simultaneously while playing a gaming machine.

9 Claims, 5 Drawing Sheets

GAMING MACHINE HAVING FOLDABLE UTILITY SHELF

FIELD OF THE INVENTION

The embodiments of the present invention relate to a gaming machine including a utility shelf configured to move between a stowed position and a play position.

BACKGROUND

To attract slot machine players, many casinos offer patrons bingo games which are conducted in a segregated bingo room. The bingo rooms occupy expensive casino floor space and are labor-intensive. Accordingly, there exists a need to provide gaming machine players with accommodations for playing live bingo games while they also play gaming machines on the main casino floor. In this manner, the casino continues to generate gaming machine revenue while players play the live bingo games.

Accordingly, it would be advantageous to develop a gaming machine including a foldable utility shelf to accommodate bingo cards and related paraphernalia.

SUMMARY

A first embodiment of the present invention involves a gaming machine having at least a cabinet, display and user interface, comprising: a utility shelf movably attached to said cabinet, said utility shelf adapted to move between a stowed position and a play position whereby said stowed position is substantially non-horizontal and said play position is substantially horizontal. In this manner, gaming machine players may play bingo (or other card-based and paper-based live games such as keno) simultaneously while playing a gaming machine.

As used herein, gaming machines mean any upright standing gaming machine including slot machines, video bingo machines, video keno machines, video poker machines, etc. As used herein, cabinet and housing are both rigid structures configured to contain certain components (e.g., processor) of the gaming machine while allowing certain components (e.g., bill validator) to be accessed through openings in the cabinet or housing. The cabinet or housing may have a door providing internal access as well.

Other variations, embodiments and features of the present invention will become evident from the following detailed description, drawings and claims.

DETAILED DESCRIPTION

Figure 1:
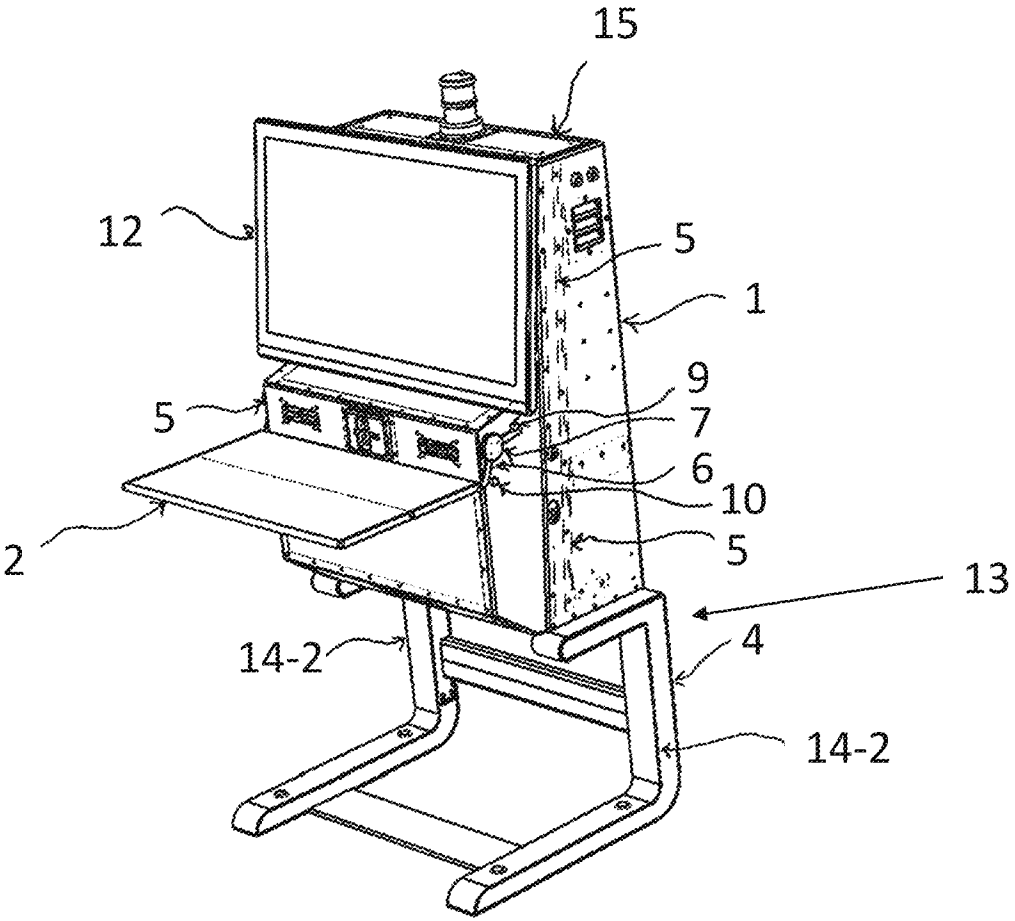
FIG. 1 illustrates an exemplary gaming machine equipped with a foldable utility shelf positioned in a substantially horizontal, play position according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 shows gaming machine 1 equipped with a foldable utility shelf 2 positioned in a horizontal (play) position. As shown, the foldable utility shelf 2 is attached to a cabinet or housing of the gaming machine 1. The shelf 2 is generally rectangular (with rounded corners) and is attached to the front door 5 of the cabinet by respective left and right V-shaped arms 6 as further illustrated in FIG. 5. The arms 6 are rotatable about left and right attachment pins 7 joined to left and right retaining rings 8. The rotation of the shelf 2 about pins 7 is limited by upper and lower stop pins 9, 10, respectively, on both sides of the front door 5 (stop pins 9 and 10 on the left side of the door are not shown on FIG. 1). The upper stop pin 9 maintains the shelf 2 in the horizontal position and the lower stop pin 10 limits the travel of the shelf 2 to the stow position as illustrated in FIG. 2.

Figure 3:
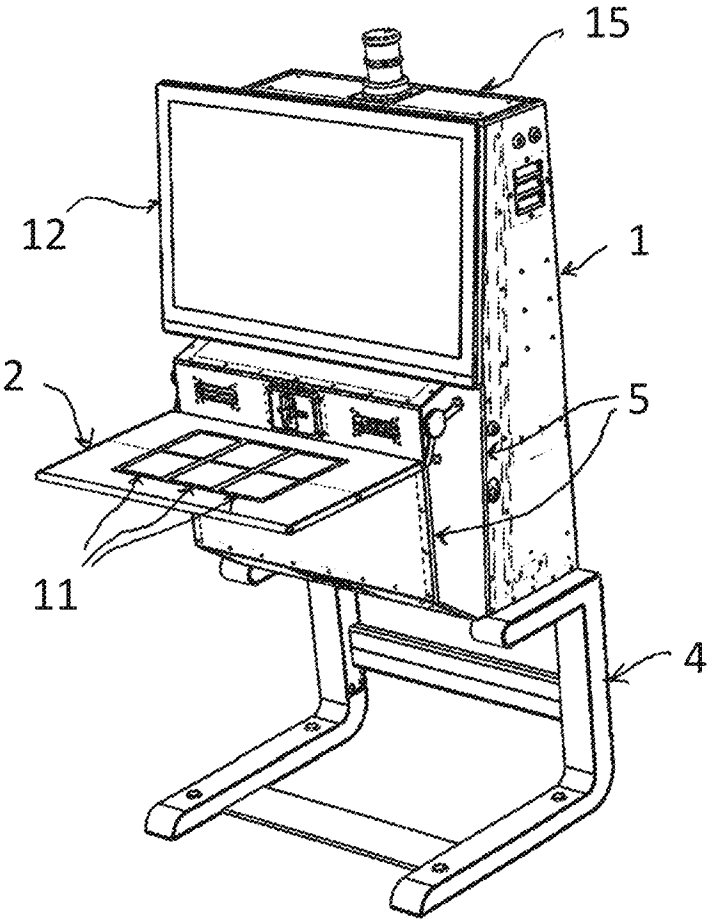
FIG. 3 illustrates an exemplary gaming machine equipped with a foldable utility shelf positioned in a substantially horizontal, play position supporting bingo cards according to the embodiments of the present invention.

When the shelf 2 is in the horizontal position, paper bingo cards 11 and/or other game paraphernalia (e.g., bingo daubers) can be placed on top thereof as illustrated in FIG. 3. In the horizontal position, the shelf 2 does not obstruct a player's view of and player's access to the gaming machine's touch screen 12, so that players can daub the paper bingo cards 11 while also playing video games (e.g., video slot and/or electronic bingo on the touchscreen 12) on the gaming machine 1.

Figure 2:
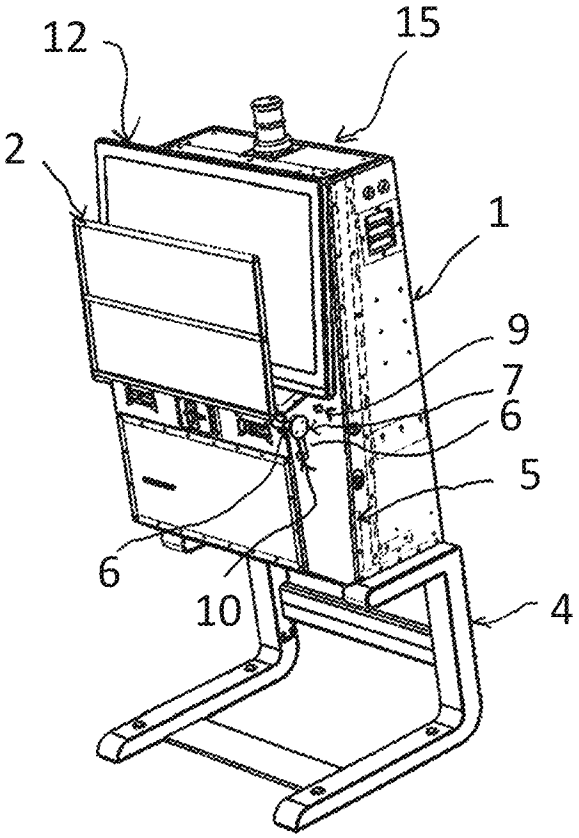
FIG. 2 illustrates an exemplary gaming machine equipped with a foldable utility shelf positioned in a substantially vertical, stowed position according to the embodiments of the present invention.

In a vertical position, the shelf 2 is folded as shown in FIG. 2 (e.g., to provide service access to the internal components of the gaming machine 1). Importantly, when the front door 5 is open (e.g., by a service person) the shelf 2 being in the vertical position does not contact the neighboring or adjacent gaming machine. Gaming machines are typically placed tightly next to one another on the casino floor with the typical distance between adjacent gaming machines being only twenty-eight inches.

In one embodiment, the gaming machine 1 is supported by a U-shaped stand 4 illustrated in FIG. 1. In one embodiment, the stand 4 is adapted to allow a player to place feet under the gaming machine 1 with the open, front side of the generally U-shaped stand 4 facing the player, while a back side 13 of the stand 4 is bearing the weight of the gaming machine 1. In such instance, the combination of the shelf 2 in its horizontal position and the open space inside of the gaming machine stand 4 forms a convenient, desk-like play environment while reducing the overall floor space required for the gaming machine 1.

Figure 4:
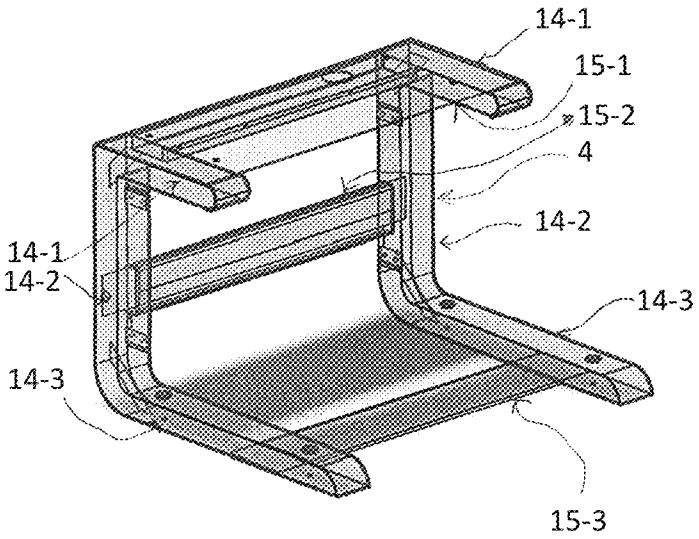
FIG. 4 illustrates a gaming machine stand according to the embodiments of the present invention.

A design of an exemplary embodiment of such a gaming machine stand 4 is illustrated in FIG. 4. The gaming machine stand 4 comprises U-shaped side supports 14-1, 14-2 and 14-3 and horizontal supports 15-1, 15-2 and 15-3. The side supports 14-1, 14-2 and 14-3 and horizontal supports 15-1,

15-2 and 15-3 are attached (e.g., bolted and/or welded) to one another to provide rigidity. One advantage of the gaming machine stand 4 is the absence of the front and side walls (normally present in box-like conventional slot stands) that limit movement/placement of a player's knees and legs.

Figure 5:
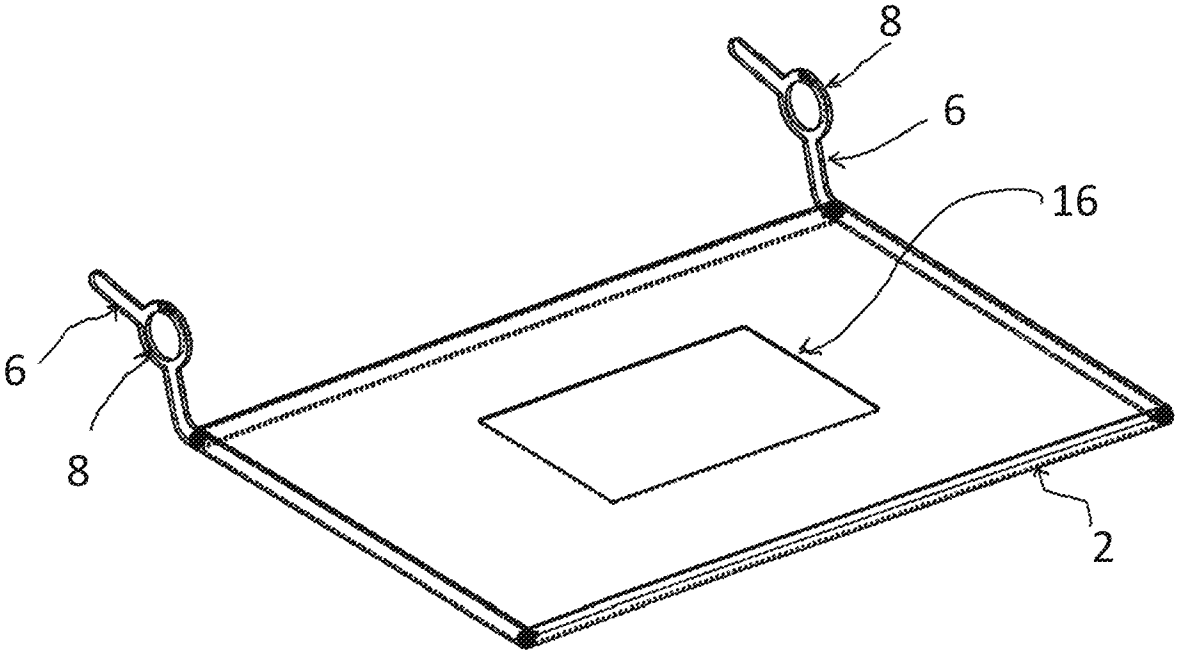
FIG. 5 illustrates an alternative embodiment wherein the foldable utility shelf includes an embedded electronic WiFi pad according to the embodiments of the present invention.

The embodiments of the present invention may be implemented in various configurations without departing from its main principles. For example, the shelf 2 may be folded down (e.g., for service) while in the stowed position. Also, the shelf 2 may be attached to the cabinet/housing 15 of the gaming machine 1 rather than the front door 5 or maybe attached to the gaming machine stand 4. In addition, as illustrated in FIG. 5, the shelf 2 may incorporate an electronic pad, e.g. a WiFi bingo player unit 16, such as a bingo player unit disclosed in U.S. Pat. No. 7,611,407 to Itkis et al and incorporated herein for all purposes. The WiFi bingo unit 16 may be powered via wires (not explicitly shown in FIG. 5) running inside of the V-shaped arms 6.

The foldable utility shelf 2 may be joined to the gaming machine 1 as an aftermarket unit or may be fabricated as part of the gaming machine. The utility shelf 2 may be attached to the gaming machine, cabinet, housing and/or stand using any appropriate means including pins (as set forth above), screws, rivets, magnets or other fasteners which permit the utility shelf to rotate from a stowed position to a play position and vice versa.

Although the invention has been described in detail with reference to several embodiments, additional variations and modifications exist within the scope and spirit of the invention as described and defined in the following claims.

We claim:

1. A gaming machine having at least a cabinet, a display and a user interface, comprising:

a utility shelf movably attached to said cabinet, said utility shelf adapted to move between a stowed position and a play position whereby said stowed position is vertical and said play position is horizontal, said utility shelf is attached to said cabinet via arms rotatable about attachment pins joined to retaining rings connected to said cabinet whereby rotation of said utility shelf about said attachment pins is limited by upper and lower stop pins; and wherein, when said utility shelf is in said stowed position, said utility shelf rests in front of, and conceals a portion of, said display, and when in said play position extends horizontally away from said cabinet.

2. The gaming machine of claim 1 wherein said cabinet includes a front door.

3. The gaming machine of claim 2 wherein said utility shelf folds upward to prevent said utility shelf from contacting an adjacent gaming machine when said front door is open.

4. The gaming machine of claim 1 wherein said utility shelf is foldable.

5. The gaming machine of claim 1 wherein when in said play position said utility shelf is adapted for placement of game paraphernalia thereupon.

6. The gaming machine of claim 1 wherein said utility shelf incorporates a touchscreen WiFi tablet adapted to play a game of chance.

7. A gaming machine having at least a cabinet, a display and a user interface, comprising:

a utility shelf having a pair of spaced arms rotatably attached to opposite sides of said cabinet, said utility shelf is attached to said cabinet via arms rotatable about attachment pins joined to retaining rings connected to said cabinet whereby rotation of said utility shelf about said attachment pins is limited by upper and lower stop pins;

an upper and lower stop pin on each of said opposite sides of said cabinet, said upper and lower stop pins positioned to limit movement of said utility shelf between a stowed position and a play position whereby said stowed position is vertical and said play position is horizontal; and wherein, when said utility shelf is in said stowed position, said utility shelf rests in front of, and conceals a portion of, said display, and when in said play position extends horizontally away from said cabinet.

8. The gaming machine of claim 7 wherein said cabinet includes a front door.

9. The gaming machine of claim 7 wherein said utility shelf incorporates a touchscreen WiFi tablet adapted to play a game of chance.

* * * * *